United States Patent [19]

MacLean

[11] Patent Number: 4,887,321

[45] Date of Patent: Dec. 19, 1989

[54] SANITARY TOILET SEAT COVER

[76] Inventor: Mary MacLean, 7315 - 1st Street, Burnaby, B.C., Canada, V3N 3S7

[21] Appl. No.: 843,840

[22] Filed: Mar. 26, 1986

Related U.S. Application Data

[63] Continuation of Ser. No. 671,068, Nov. 14, 1984, abandoned, which is a continuation-in-part of Ser. No. 409,512, Aug. 19, 1982, abandoned.

[30] Foreign Application Priority Data

Jul. 29, 1982 [CA] Canada ..... 408352

[51] Int. Cl.[4] ..... A47K 13/14

[52] U.S. Cl. ..... 4/243

[58] Field of Search ..... 4/243, 245

[56] References Cited

U.S. PATENT DOCUMENTS

| | | | |
|---|---|---|---|
| 787,357 | 6/1905 | Davis . | |
| 1,138,440 | 5/1915 | Bainbridge-Bell | 4/243 |
| 1,155,260 | 9/1915 | Meyer | 4/243 |
| 1,268,024 | 5/1918 | Levin | 4/243 |
| 1,293,955 | 2/1919 | Sloan | 4/243 |
| 1,377,791 | 5/1921 | Potschner | 4/243 |
| 1,509,868 | 9/1924 | Harrison | 4/243 |
| 1,835,787 | 12/1931 | Knisely | 4/243 |
| 1,961,195 | 10/1932 | Carruthers | 206/494 |
| 2,200,394 | 5/1940 | Leslie | 4/243 |
| 2,266,990 | 12/1941 | Rea | 493/340 |
| 2,742,650 | 4/1956 | Mohun et al. | 4/242 |
| 3,348,243 | 10/1967 | Kelly | 4/245 |
| 4,050,105 | 9/1977 | Marceaux | 4/243 |

FOREIGN PATENT DOCUMENTS

| | | | |
|---|---|---|---|
| 233981 | 12/1923 | Canada . | |
| 239965 | 5/1924 | Canada . | |
| 240525 | 6/1924 | Canada . | |
| 287121 | 2/1929 | Canada . | |
| 315162 | 9/1931 | Canada . | |
| 327046 | 10/1932 | Canada . | |
| 335427 | 9/1939 | Canada . | |
| 525797 | 2/1953 | Canada . | |
| 663767 | 5/1963 | Canada . | |
| 705063 | 3/1965 | Canada . | |
| 1121107 | 4/1982 | Canada . | |
| 2531269 | 12/1975 | Fed. Rep. of Germany | 4/243 |

*Primary Examiner*—Charles E. Phillips

*Attorney, Agent, or Firm*—Birch, Stewart, Kolasch & Birch

[57] ABSTRACT

A novel toilet seat cover is provided herein. The cover comprises a water-impermeable, very light weight, easily disposible paper, the paper being in the form of a porous paper coated only on the reverse side thereof which is adapted to face the toilet bowl with a water-repellent material, thereby retaining a porous paper surface for contact with the user while rendering the paper as a whole water impermeable and non-porous, the paper being provided with a single central straight line longitudinal slit opening or a perforation or line of weakness. The toilet seat cover is folded longitudinally along the slit or perforation and then is folded transversely in a zig-zag or back-and-forth accordion-type fold to be folded at least for the region of the slit or perforation. The toilet seat cover, when in use, is adapted to be placed over the toilet seat and to have its peripheral edges folded under the toilet seat to be retained thereby. Further, by the sole application of body pressure by the user, the toilet seat cover is thus adapted to be made to fit a toilet seat opening automatically. The toilet seat cover may be dispersed in the form of individual folded seat covers or in the form of a seat cover detached from a roll of a plurality of identical seat covers. Thus, with the present invention, the entire sheet is placed on the toilet seat, and the peripheral edges then folded under the toilet seat so that the cover may be retained thereby. Then, by the user sitting on the cover, the slit or perforation automatically extends and expands to provide the optimum opening.

8 Claims, 6 Drawing Sheets

SANITARY TOILET SEAT COVER

This application is a continuation of application Ser. No. 671,068 filed on 11/14/84 which is a continuation-in-part of Ser. No. 409,512 filed on 8/19/82, both now abandoned.

BACKGROUND OF THE INVENTION (i) Field of the Invention

This invention relates to a sanitary toilet seat cover.

(ii) Description of the Prior Art

It is now known that many venereal disease germs may remain on a toilet seat for many hours. In order to prevent the spread of such diseases, it is therefore very critical that a very sanitary toilet seat cover be available. Such sheet should be of a contour and size adapted to overlie and fit the ordinary toilet seat, the sheet being formed, preferably, of paper, and designed for individual use and immediate destruction. Such sheet should also have a centrl portion adapted to provide an opening with the usual toilet seat opening.

Many such toilet seat covers have been proposed in the past. In U.S. Pat. No. 787,357 issued Apr. 18, 1905 to G. H. Davis, such a seat cover is provided which is in the form a single sheet having a impositively secured central portion to provide a central opening and which is formed and folded to provide a single entity independent of all other sheets. Such articles may then be vended in suitable machines furnished for that purpose or in packets of convenient numbers for travelling kits and the like.

U.S. Pat. No. 1,138,440 patented May 4, 1915 by E. L. Bainbridge-Bell provides a sanitary shield in the form of a sheet of suitable material weakened adjacent one end on two quadarant lines jointly forming a broken semicircle curved toward the center of the sheet. The sheet is similarly weakened adjacent the other end on quadrant lines jointly forming a broken semi-circle curved toward the center of the sheet. The sheet is finally weakened on a median line from a point adjacent one semi-circular line to a point adjacent the center of the sheet, and is similarly weakened on a median line from a point adjacent the other semi-circular line to a point adjacent the center of the sheet. This provides an opening bounded for four downwardly projecting shields.

U.S. Pat. No. 1,155,260 patented Sept. 28, 1915 by H. F. W. Meyer provides a sanitary seat cover comprising a thin sheet of paper of oval contour having an oblong central opening. The material is accordion folded around two sides and one end on predetermined score lines. The opposite end of the material is folded on predetermined score lines and forms a housing receiving the sides and first end in folded position. The device is adapted to assume a flat condition upon removal of the sides and end from within the housing.

U.S. Pat. No. 1,268,024 patented May 28, 1918 by I. Levin provides a toilet seat protector comprising an annulus of creped paper having a waxed margin and formed with perforations adjacent to its outer edge. The annulus has longitudinal, transverse and diagonal fold lines.

U.S. Pat. No. 1,377,791 patented May 10, 1921 by K. Putchner provides a commode seat cover consisting of a sheet of thin paper having two longitudinally extending cuts, approximately parallel to each other, and a transverse cut disposed between but not intersecting the parallel cuts. The transverse cut is so located that when longitudinal strain is placed upon the sheet of paper across the transverse cut, the paper will tear transversely from the transverse cut, in opposite directions to the longitudinal cuts. This provides an opening having forward and rear flap. The sheet is interfolded to be disposed in five layers.

U.S. Pat. No. 1,509,868 patented Sept. 30, 1924 by T. P. Harris provides a sanitary covering for seats which has broad flaps positioned to hang one at the front and one at the back of the cover, and thus to depend into the closet bowl, provides means for preventing the cover from slipping off the toilet seat and also means for preventing the cover from twisting around the seat due to the fact that the flaps are positioned at the ends of the longest dimension of the opening in the cover. The flap has a particular shape i.e. it broadens out immediately from its point of support to provide a very broad protecting surface both front and rear, thus effectively guarding the user against contact with the seat or with the parts of the bowl therebeneath. Because of the width of the depending flap the splashing of water when the bowl may be flushed is reduced to a minimum. This particular broadened flap is struck from the material of the sheet and extends substantially the full width of the opening when the flap and sheet lie in the same plane.

U.S. Pat. No. 1,835,787 patented Dec. 8, 1931 by M. H. Kniseley provides a sanitary closed seat cover comprising a rectangular cover piece with fold thereacross to form treble thickness. A flap is cut through the center thereof and across the treble thickness fold. The increased length is adapted to extend into the water of the toilet bowl, the folds at each side of the flap being cemented.

U.S. Pat. No. 1,961,195 issued June 5, 1934 to G. Carruthers provides a protective toilet seat cover of the type having a semi-detached pattern cut therein to provide a displaceable opening forming portion. The sheet is folded continuously from one end to the other in a common direction, as distinguished from the back and forth or zig-zag type of fold. The outer folds are coiled around and enclose the inner folds and fold edges. In this way, the folds retain the patterned portion and cut edges from exposure.

U.S. Pat. No. 2,266,990 issued Dec. 23, 1941 to P. F. Rea provides toilet seat covers which are in the form of prefolding a sheet of paper, having discontinuous incisions across the fold. The edges and ends of the folded sheet are trimmed.

U.S. Pat. No. 2,742,650 issued Apr. 24, 1956 to M. Mohun provides a foldable auxiliary toilet seat comprised of forward and rearward pairs of oppositely disposed flat, relatively stiff members. The ends of the pairs of members are disposed substantially along the longitudinal fold line of the seat. Hinge means interconnect the members of each pair. Special means are provided which are adapted to resist a collapsing folding action of the seat about the longitudinal fold line when the seat is positioned for use. Such means are in the form of spaced notches formed in the ends of the members of each pair, such notches defining finger-like elements therebetween. The finger-like elements of each member extend through the notches of the other member into overlapping relation with the other member.

U.S. Pat. No. 4,050,105 issued Sept. 17, 1977 to L. S. Marceaux provides a disposible toilet seat cover for a toilet seat surface area for accommodating a user. The toilet seat cover has a front crotch, a back part, an inner side and an outer side providing a smooth contour and shape, and a bottom surface area opposite to the surface area of the toilet seat. The disposable toilet seat cover has the contour and shape of the top contour of a toilet seat but is of larger dimensions so that it ranges over the outer side of the toilet seat. The cover is made of paper flushable in a toilet. The cover has an inner center flap and an outer circumference consisting solely of paper and extends beyond and inwardly and outwardly of the toilet seat opening and fastened at the front central part of the toilet seat. The fastening is by means of a pair of spaced flaps consisting solely of paper positioned at the back part of the toilet seat, the flaps having self-adhesive tabs for removably affixing the cover to the bottom surface of the toilet seat.

Canadian Pat. No. 233,981 issued Sept. 4, 1923 to H. H. Schwartz provides a sanitary toilet seat protector comprising a sheet of paper shaped to fit a toilet seat and having its central portion cut on straight lines to form an oval-shaped opening. It also has a plurality of relatively long narrow strips of paper arranged to hang downwardly at relatively close intervals entirely around the oval-shaped opening. A section of toilet paper is detachably connected with one end of the seat protector.

Canadian Patent No. 239,965 issued May 13, 1924 to N. H. C. Brown provides a sanitary seat cover for toilet seats comprising a sheet having a plurality of slits. The inner extremities of the slits terminate prior to reaching the centre portion of the cover, so that an unslit central portion is constituted, and an opening is provided defined by the depending, hanging slits.

Canadian Patent No. 240,525 issued June 3, 1924 to W. Teale et al. provides a sanitary cover for toilet seats, comprising a paper body having a flap portion formed entirely within the margin of such body. It is normally severed therefrom except for the full width of the flap at one end and has filament connections at the opposite end.

Canadian Patent No. 287,122 issued Feb. 12, 1929 to T. R. Griffith provides a cover for toilet seats, comprising a flexible elastic cover portion designed to fit over the upper portion of the seat to conform with the sides thereof. The edges of the cover are turned inwardly to provide a gripping edge under the inner and outer contours of the seat.

Canadian Patent No. 315,162 issued Dec. 15, 1931 provides an improvement in seat protectors. The improvement includes a plurality of odorous sanitized packets each being extendible into a ring of flimsy paper folded in leaves from a common fold closing one side of a converging packet made for vending purposes.

Canadian Patent No. 327,046 issued Apr. 25, 1932 provides a toilet seat cover sheet in the form of a package of toilet paper, consisting of a plurality of rectangular sheets. Each sheet of the package has parallel incisions and aligned perforations extending entirely across the sheet in one direction. The sheet is folded lengthwise into overlying strips along the lines of incisions and perforations. Perforations extend entirely across the sheet, normal to the incisions. The strips are folded one over the other and are thereby adapted to be torn apart on the normal perforations into sections of toilet paper of standard size. The incisions further divide the sheet into a U-shaped perimetric portion and an interior flap.

Canadian Patent No. 335,427 issued Sept. 3, 1933 provides a folded toilet sheet in the form of a sheet of paper having a pattern cut through the surface. The toilet sheet is folded in a plurality of parallel folds to place the cuts in each successive fold in divergent relation to the adjacent fold and finally to enclose the cut portions.

Canadian Pat. No. 525,797 issued June 5, 1956 to I. B. Woodford provides an improvement in a cover for a toilet seat. It includes a fabric blank shaped to conform to the outline of the toilet seat and has an opening disposed substantially centrally thereof. Binding tapes are provided having one edge positioned upon one face of the blank adjacent each of the bounding edge of the blank and of the bounding wall of the opening and are secured thereto. The portion of the binding tape which is contiguous to one secured edge is turned about the adjacent bounding edge of the blank, and the bounding wall of the opening has the portion adjacent its other edge disposed in confronting relation with respect to the other face of the blank. The other edge of each of the tapes is secured to the blank, thereby to form a pair of oval sheaths. A resilient element is fixedly positioned within each of the sheaths and extends therearound. This element urges the peripheral portions of the blank into engagement with the toilet seat.

Canadian Patent No. 663,767 issued May 28, 1967 to R. Cluxton provides a removable cover for toilet seats in the form of an envelope cover comprising a fabric blank. The fabric blank has a central opening approximating the shape of the opening in the toilet seat. A binding is stitched to the outer peripheral edge of the fabric blank, the binding being formed of an elastic material stretched lengthwise about the outer peripheral edge of the fabric blank and stitched thereto while in its stretched condition. The binding on its contracted state thereby draws the blank into an envelope fitting snugly on the toilet seat surface and about its peripheral edge.

Canadian Pat. No. 705,063 issued Mar. 9, 1965 to A. E. Warnberg provides a cover for a toilet seat comprising a panel of pliable material confirming generally in configuration to the shape of the toilet seat. An endless, annular stiffening member is secured around the inner periphery of the panel for holding the inner edge of the panel against the bottom of the seat adjacent the inner edge thereof, the length of the endless stiffening member being larger than the inner periphery of the toilet seat. Adjustable means are provided for securing the outer edge portion of the panel around the outer edge of the toilet seat.

Canadian Patent No. 1,121,107 issued Apr. 6, 1982 to C. L. Robertom provides a cover for a water closet seat. The seat includes an annular panel of flexible fabric having an inner peripheral edge and an outer peripheral edge. Means are mounted around the outer peripheral edge of the panel for drawing the outer peripheral edge up underneath the outer edge of a water closet seat. A hem channel is provided around the inner peripheral edge of the panel and this channel has an opening thereinto. A channel closure extends transversely across and blocks the hem channel at one point around its peripheral extend which is spaced from the opening into the channel. Finally, a resilient, flexible stiffening member is provided in the hem channel. This stiffening member has a first end positioned immediately adjacent the channel closure, and a second end immediately adjacent the channel closure and on the opposite side thereof from the first end. The stiffening member has a portion between the first and the second ends which bridges across the channel opening.

SUMMARY OF THE INVENTION (i) Aims of the Invention

In spite of all these patents, there still is a need for, and it is amongst the objects of the present invention to provide, a toilet seat cover which has the following characteristics and advantages:

1. It is formed of disposible paper which may be used in either the right side up or the wrong side up.
2. It is water-retardant and water-repellent.
3. It folds to a convenient pocket or purse size.
4. It may be formed of non-porous "waxy" paper.
5. It is portable.
6. It protects the base of the spine and the genitals.
7. It is suitable for all ages and both sexes.
8. It is comfortable to utilize.
9. It fits all styles of toilet seats.
10. It will not tear easily and yet adjusts easily.
11. It can be dispensed in the same manner as absorbent tissues. and
12. It tucks under the toilet seat on each side of the toilet to be held in place thereby.

(ii) Statements of Invention

By the present invention, a toilet seat cover is provided comprising a water-impermeable, very light weight, easily disposible paper, the paper being in the form of a porous paper coated only on the reverse side thereof which is adapted to face the toilet bowl with a water-repellent material, thereby retaining a porous paper surface for contact with the user, while rendering the paper as a whole water-impermeable and non-porous, the paper being provided with a single central straight line longitudinal opening, in the form of a slit or a perforation or a line of weakness, the toilet seat cover being folded longitudinally along the opening and then folded transversely in a zig-zag or back-and-forth accordion-type fold, at least within the region of the central longitudinal opening, the toilet seat cover, having peripheral edges foldable under toilet seat on which the toilet seat cover is adapted to be placed and, being automatically fittable to fit a toilet seat opening by the sole application of body pressure thereto.

(iii) Other Features of the Invention

By another feature of this invention, the central opening is in the form of a slit, or a perforation or a line of weakness, the toilet seat cover being folded longitudinally along the opening and then folded transversely in a zig-zag or back-and-forth accordion-type fold for its entire length, the toilet seat cover, when in use, being adapted to be placed over a toilet seat and to have its peripheral edges folded under the toilet seat to be retained thereby, and further, by the sole application of body pressure by the user, being adapted to be made to fit a toilet seat opening automatically.

By another feature of this invention, the central opening is in the form of a slit, or a perforation or a line of weakness being folded longitudinally along the opening and folded transversely in a zig-zag or back-and-forth accordion-type fold solely in the region of the central longitudinal opening.

By another feature of this invention, the shape of the toilet seat cover may be rectangular, round, heart-shaped or oval.

By yet another feature of this invention, the water-repellent material is wax.

By still another feature of this invention, the paper may be provided with a printed advertising or instruction message and may be provided in many attractive colors.

By a still further feature of this invention, the toilet seat cover is provided in rolled-up form in which each individual seat cover is connected to each preceding and subsequent seat cover by a separable connection.

BRIEF DESCRIPTION OF THE DRAWINGS

In the accompanying drawings.

DESCRIPTION OF PREFERRED EMBODIMENTS (i) Description of FIGS. 1–6

Figure 1:
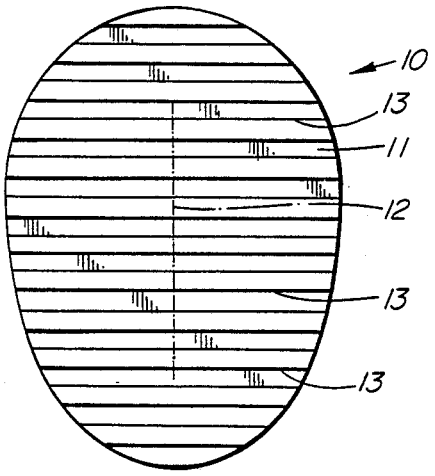
FIG. 1 is a top plan view of the toilet seat cover of one embodiment of this invention.
Figure 2:
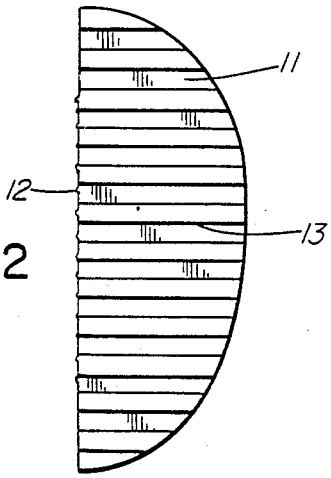
FIG. 2 is a top plan view of the toilet seat cover of FIG. 1 after it has been folded longitudinally in half in the initial stage of its folding to a convenient pocket or purse size.
Figure 3:
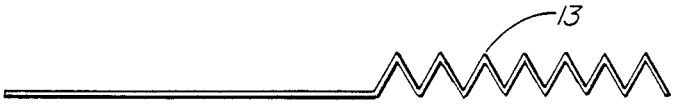
FIG. 3 is a side elevational view of the initial stages of the accordian-type folding-up of the toilet seat cover.
Figure 4:
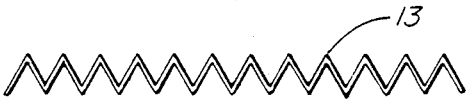
FIG. 4 is a side elevational view of the accordian-folded toilet seat cover of an embodiment of the invention.
Figure 5:
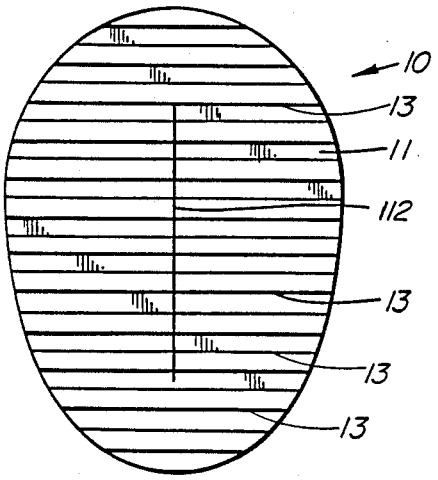
FIG. 5 is a top plan view of the toilet seat cover of a second embodiment of this invention.

As seen in FIGS. 1 and 5, the toilet seat cover 10 is in the form of an oval sheet 11 of water-impermeable, non-porous, light weight, easily disposible paper, preferably waxy. As used herein, the term "paper" is intended to mean "a substance composed of fibres interlaced into a compact web, made from linen and cotton rags, straw, wood, certain grasses, synthetic plastics materials, e.g., polyethylene, etc., which are macerated into a pulp, dried, and pressed, or are interlaced and pressed in the non-aqueous state without the intermediate step of being macerated into an aqueous pulp and dried". The paper may be an open sheet or may be a porous paper coated with a synthetic plastics material, i.e., polyethylene, or with a wax, i.e., that described as one of a group of unctous, fusible, variable viscous to solid substances, having a characteristic waxy luster, which are insoluble in water but which are soluble in most organic solvents. Waxes are extremely susceptible to changes in temperature and their origin, composition and color are variable. They are usually composed of high molecular weight substances, and may be grouped according to their origin as follows: (a) Animal: spermaceti, beeswax, stearic acid, Chinese wax, etc. (b) Vegetable: carnuba, Japan, bayberry, candelilla, etc. The animal and vegetable waxes are mostly fatty acid esters of higher monohydroxy alcohols, as for example, ceryl cerotate. (c) Mineral: ozocerite montan, ceresin, paraffin, etc. These mineral waxes are usually high molecular weight esters of hydrocarbons. (d) Synthetic (varied chemically), as the medium weight polyethylenes, polyethylene glycols and polyoxyethylene esters, chloronaphthalenes, sorbitols, chlorotrifluoroethylene resins.

If the paper is in the form of an open sheet, this allows rapid penetration of the wax, which has a dense structure. When waxed, the paper provides a smooth layer of surface wax as a protective barrier.

Polyethylene, if used, is generally applied to the paper whether it is an open sheet porous paper or a dense sheet, by film extrusion.

The toilet seat cover 10 is provided with a central longitudinal opening, either in the form of a slit precursor, e.g., a perforation or a weakened area (i.e., 12 in FIG. 1) or as a slit (i.e., 112 in FIG. 5) extending approximately 40% of the longitudinal length of the sheet 11. Also shown are a plurality of evenly spaced-apart parallel transverse weakened or fold lines 13.

While the sheet 11 is shown to be oval shaped, it may be rectangular, rounded-cornered, rectangular, round, heart-shaped, or any desired shape as long as it is large enough in both diections to fit over a toilet seat.

Figure 6:
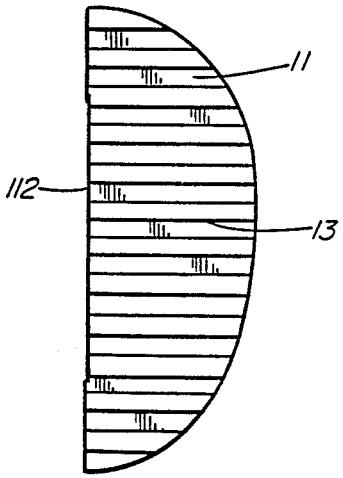
FIG. 6 is a top plan view of the toilet seat cover of FIG. 5 after it has been folded longitudinally in half in the initial stage of its folding to a convenient pocket or purse size.

A series of sequential views of the folding up in accordion-fold fashion is shown in FIGS. 2 and 6 and 3–4. First, the sheet 11 is folded in half longitudinally along perforation or weakened area 12 (in FIG. 2) or along slit 112 (FIG. 6). Then it is accordion-folded along weakened lines 13 until it passes through the configuration shown in FIG. 3 to the final form shown in FIG. 4.

(ii) Description of FIGS. 7–11

Figure 7:
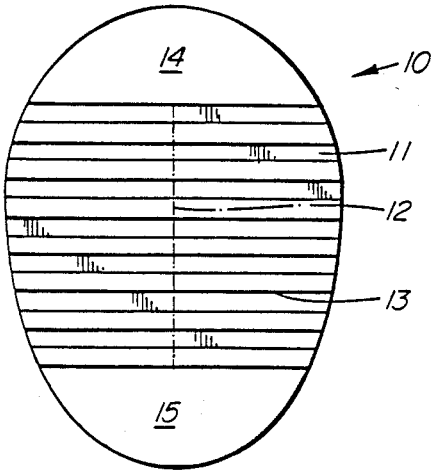
FIG. 7 is a top plan view of the toilet seat cover of a third embodiment of this invention.
Figure 8:
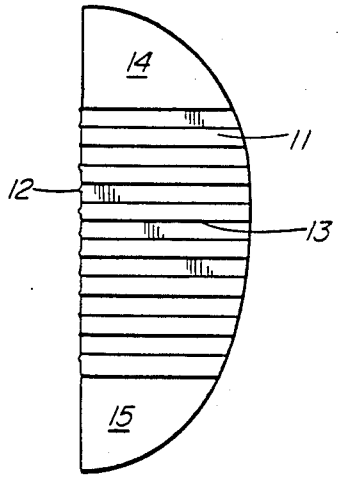
FIG. 8 is a top plan view of the toilet seat cover of FIG. 7 after it has been folded longitudinally in half in the initial stage of its folding to a convenient pocket or purse size.
Figure 9:
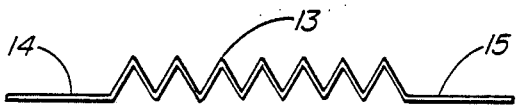
FIG. 9 is a side elevational view of the accordian-folded toilet seat cover of the embodiment of FIG. 7 of the invention.
Figure 10:
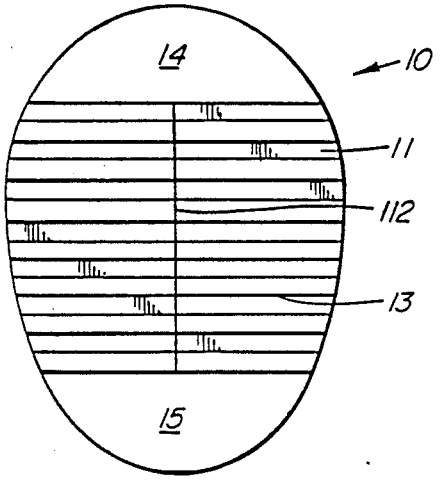
FIG. 10 is a top plan view of the toilet seat cover of a fourth embodiment of this invention.
Figure 11:
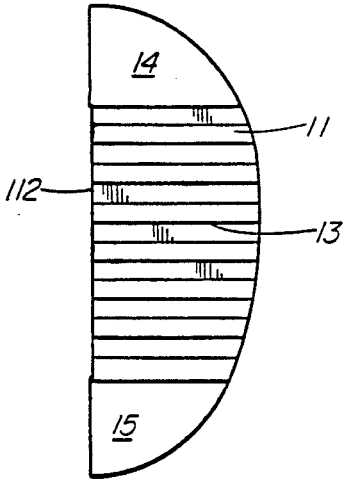
FIG. 11 is a top plan view of the toilet seat cover of FIG. 10 after it has been folded longitudinally in half in the initial stage of its folding to a convenient pocket or purse size.

Two other embodiments of the invention are shown in FIGS. 7–9 (based on the embodiment of FIGS. 1–4) and FIGS. 10 and 11 (based on the embodiment of FIGS. 5 and 6). Where similar parts are shown by the same reference numerals, they will not be described further.

It will be seen that the essential difference in these embodiments is that the upper portion 14 and the lower portion 15 are not provided with weakened or fold lines 13. Instead they remain as unfolded sheets of paper. This results in the folded-up form being as shown in FIG. 9. This form may be provided if it is desired to dispense the toilet seat cover as a single prefolded item, since it provides convenient gripping areas 14 and 15.

Figure 16:
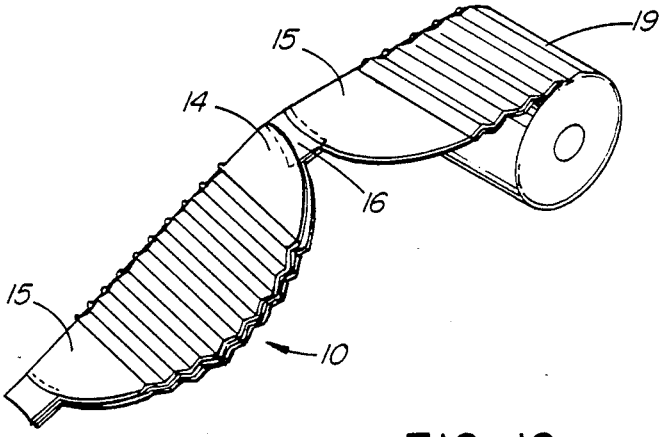
FIG. 16 is a perspective view of the roll form of the invention of FIGS. 12 or 14.
Figure 12:
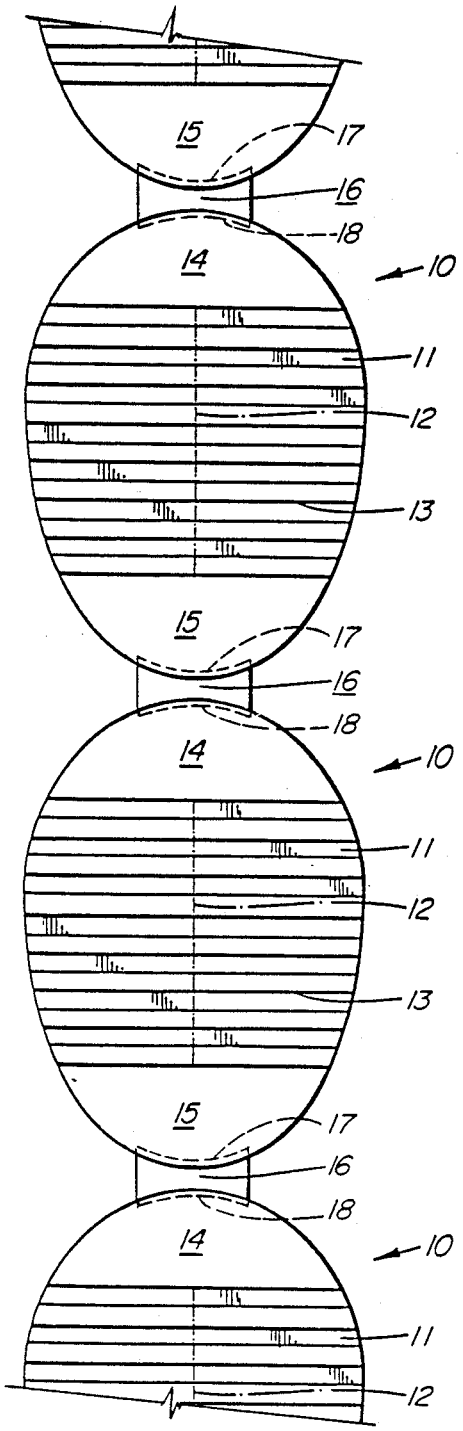
FIG. 12 is a top plan view of the toilet seat cover of a fifth embodiment of this invention.
Figure 13:
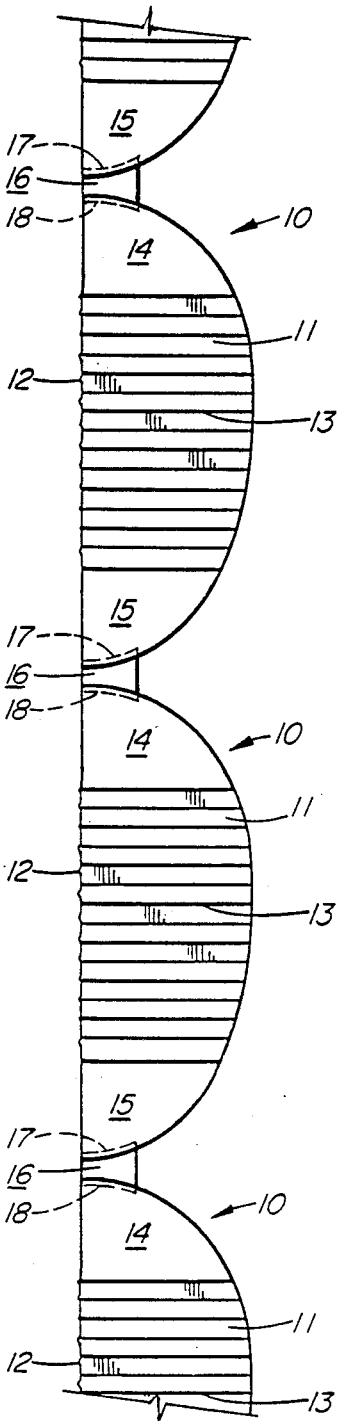
FIG. 13 is a top plan view of the toilet seat cover of FIG. 12 after it has been folded longitudinally in half in the initial stage of its assembly into roll forms.
Figure 14:
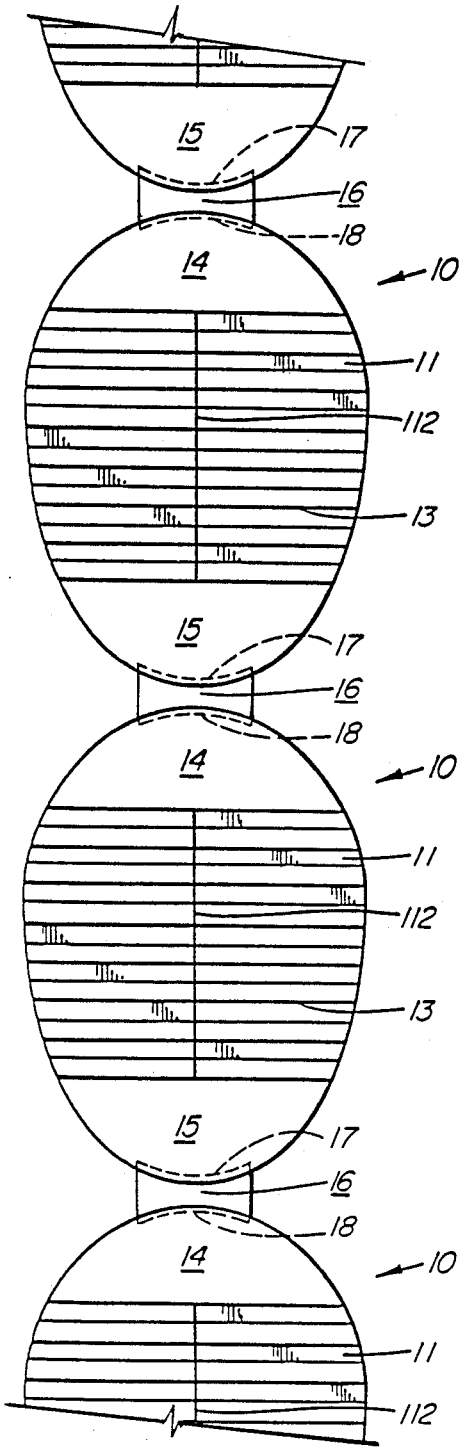
FIG. 14 is a top plan view of the toilet seat cover of a sixth embodiment of this invention.
Figure 15:
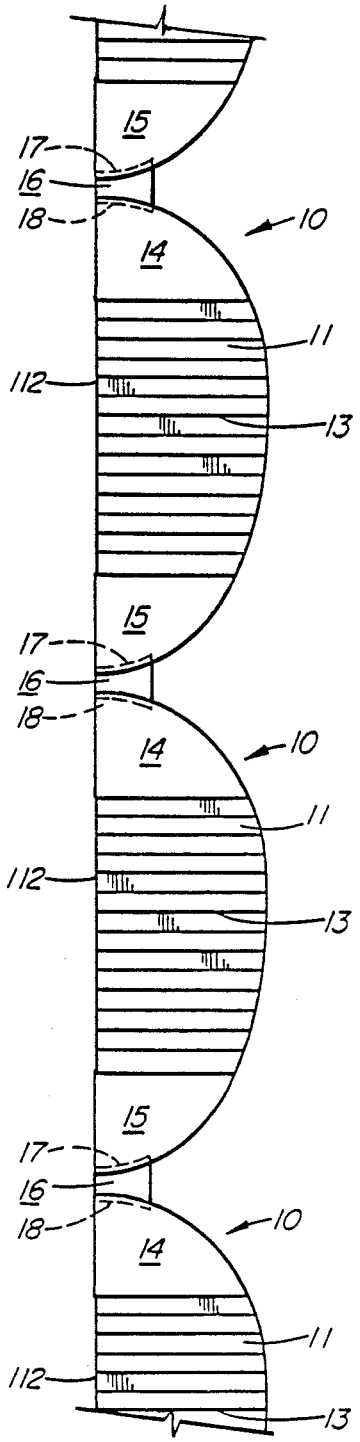
FIG. 15 is a top plan view of the toilet seat cover of FIG. 14 after it has been folded longitudinally in half in the initial stage of its assembly into roll forms.

(iii) Description of FIGS. 14–16

FIGS. 14, 15 and 16 show two additional embodiments based on the embodiments of FIGS. 7–8 and 10–11, respectively. Where similar parts are shown by the same reference numerals, they will not be described further.

It will be seen that the essential difference in these embodiments is the provision of the separable connection, in the form of a uniting tab 16 separably connected to the previous toilet seat cover 10 at perforations 17 and to the subsequent toilet seat cover 110 at perforations 18.

These two embodiments are rolled up into a roll 19 as shown in FIG. 16.

(iv) Description of a Preferred Example

For the sake of an example, the dimensions of the toilet seat cover are 53 cm×38 cm with the slit being 22 cm long and the accordion folds being 2½ cm wide. In its final folded-up form, it may be 10–13 cm long and 2½ cm wide.

OPERATION OF PREFERRED EMBODIMENT

In use it is more utilitarian and suitable than the prior art toilet seat covers which may have had tongue shaped rectangular, triangular, square, oval or round openings. In the prior art, the opening would have to approximate the toilet seat opening, and thus would provide only a minimal ara to retain the cover on the toilet seat. To avoid such problem the prior art resorted to elastic or rigid members which made the cover complicated, awkward and expensive.

On the contrary with the present invention, the entire sheet is placed on the toilet seat, and the peripheral edges then folded under the toilet seat so that the cover may be retained thereby. Then by the user sitting on the cover, the slit automatically extends and expands to provide the optimum opening.

SUMMARY

From the foregoing description, one skilled in the art can easily ascertain the essential characteristics of this invention, and without departing from the spirit and scope thereof, can make various changes and modifications of the invention to adapt it to various usages and conditions. Consequently, such changes and modifications are properly, equitably, and "intended" to be, within the full range of equivalence of the following claims.

I claim:

1. A compact, disposable, paper toilet seat cover comprising a water-impermeable, very light weight, easily disposable, paper, said paper being in the form of a porous paper coated only on the reverse side thereof which is adapted to face a toilet bowl when in use with a water-repellant material, thereby retaining a porous paper surface for contact with the user while rendering the paper as a whole water impermeable and non-porous, said paper being provided with a one and only, slit, perforation, or line of weakness, consisting of a single, central such straight-line longitudinal opening, extending about 40% of the length of said paper, said paper being completely free of all other slits, perforations or lines of weakness, said paper then being folded longitudinally along said opening and then being folded transversely in a zig-zag or back-and-forth accordion-type fold at least within the region of the central longitudinal opening to a size of about one-fortieth of the unfolded sheet; said toilet seat cover having peripheral edges which are adapted to be folded under a toilet seat on which said toilet seat cover is placed; and an unstructured, randomly-defined aperture being formable therethrough by the sole application of body pressure thereto while sitting on said toilet seat cover, said aperture originating from said one and only, central, straight-line, longitudinal opening by tearing of said opening; whereby accurate positioning of said one and only, central, straight-line, longitudinal opening over the center of the hole in the toilet seat is rendered redundant.

2. The toilet seat cover of claim 1 wherein said central opening is in the form of a slit, said toilet seat cover being folded longitudinally along said opening and then folded transversely in a zig-zag or back-and-forth accordion-type fold for its entire length.

3. The toilet seat cover of claim 1 wherein said central longitudinal opening is in the form of a slit, said toilet seat cover being folded longitudinally along said opening and then folded transversely in a zig-zag or back-and-forth accordion-type fold solely in the region of said central longitudinal opening.

4. The toilet seat cover of claim 1 wherein said central longitudinal opening is in the form of a perforation or a line of weakness, said toilet seat cover bein folded longitudinally along said opening and then folded transversely in a zig-zag or back-and-forth accordion-type fold for its entire length.

5. The toilet seat cover of claim 1 wherein said central longitudinal opening is in the form of a perforation or a line of weakness, said toilet seat cover being folded longitudinally along said opening and then folded transversely in a zig-zag or back-and-forth accordion-type fold solely in the region of the central longitudinal opening.

6. The toilet seat cover of claim 1 in rectangular, round, or heart-shaped or oval shape.

7. The toilet seat cover of claim 1 wherein said water repellent material is a wax.

8. The toilet seat cover of claim 1 provided with a printed advertising or instruction message and provided in many attractive colours.

* * * * *